US005593320A

United States Patent [19]

Konda et al.

[11] Patent Number: 5,593,320

[45] Date of Patent: Jan. 14, 1997

[54] WATERPROOF CONNECTOR

[75] Inventors: Kazumoto Konda, Yokkaichi; Yoshihiko Hotta, Wako, both of Japan

[73] Assignee: Sumitomo Wiring Systems, Ltd., Japan

[21] Appl. No.: 333,146

[22] Filed: Nov. 1, 1994

[30] Foreign Application Priority Data

Nov. 4, 1993 [JP] Japan ..... 5-301068

[51] Int. Cl.[6] ..... H01R 13/436; H01R 13/52

[52] U.S. Cl. ..... 439/589; 439/752

[58] Field of Search ..... 439/587, 589, 439/752

[56] References Cited

U.S. PATENT DOCUMENTS 3,040,287 6/1962 Agron et al. ..... 439/589

4,840,585 6/1989 Muzslay ..... 439/556

FOREIGN PATENT DOCUMENTS 55-68070 5/1980 Japan .

*Primary Examiner*—Neil Abrams

*Attorney, Agent, or Firm*—Bierman and Muserlian

[57] ABSTRACT

This invention provides a waterproof connector (FIG. 2) in which water is prevented from entering an inner part of a connector housing through clearances between cavities and terminal metal fixtures. Even if inner peripheries of cavities 11 and outer peripheries of terminal metal fixtures (contact) 20 are wetted with water when the waterproof connector is detached from a mating connector not shown, a waterproof annular member 25 disposed between an inner periphery of each cavity 11 and an outer periphery of each terminal metal fixture 20 prevents water from enter a connector housing 1 through a clearance between the cavity 11 and the fixture 20.

1 Claim, 4 Drawing Sheets

WATERPROOF CONNECTOR

BACKGROUND OF THE INVENTION (1) Field of the Invention

This invention relates to a waterproof connector and more particularly to a waterproof connector in which waterproofing annular members are fitted in cavities in a connector housing.

(2) Statement of the Prior Art

For convenience of explanation, an example of a conventional waterproof connector will be described below by referring to FIG. 7.

FIG. 7 is an exploded longitudinal sectional view of a conventional waterproof connector. The waterproof connector shown in FIG. 7 is disclosed in Japanes Patent Public Disclosure No. 55-68070 (1980). In the prior art shown in FIG. 7, cavities 71 and 61 having a circular cross section are formed in male and female connector housings 70 and 60. Male and female terminal metal fixtures 72 and 62 are inserted into and secured to the cavities 71 and 61, respectively.

Means for waterproofing the conventional connector consists of an O-ring 64 disposed in an inner groove in an inner periphery of a hood 63 of the female connector housing 60. When the male and female connector housings 70 and 60 are interconnected, a distal end of the male connector housing 70 presses the O-ring 64, thereby preventing water from entering the female metal fixtures 62.

It is possible in the conventional waterproofing means to carry out waterproofing of the male and female connector housings 70 and 60 connected to each other. For example, a charging connector for electric vehicles is used when a battery mounted in the electric vehicle is charged by a charger on the ground. The charging connector is detached from an inlet connector in the electric vehicle under a normal state and they are coupled with each other upon charging. Thus, conventional connectors which are subject to repeated coupling and detaching operations were not provided with waterproofing means under a detaching state. Although the male and female connector housings 70 and 60 are waterproofed upon charging, water can enter the inner parts in housings 70 and 60 through clearances between the inner peripheries of the cavities 71 and 61 and the outer peripheries of the fixtures 72 and 62. This results in corrosion of fixtures.

SUMMARY OF THE INVENTION

An object of the present invention is to provide a waterproof connector which can prevent water from entering the inner parts thereof through clearances between inner peripheries of cavities and outer peripheries of terminal metal fixtures even if the connector is detached from a mating connector.

In order to achieve the above object, in a waterproof connector of the present invention, terminal metal fixtures are inserted in cavities in a connector housing. A waterproofing annular member is disposed between an inner periphery of each cavity and an outer periphery of each terminal metal fixture.

The waterproofing annular member may be compressed in an axial direction between an engaging face formed on the inner periphery of said cavity and an engaging flange formed on said outer periphery of the terminal metal fixture. The waterproofing annular member may be compressed in a radial direction between the outer periphery of the terminal metal fixture and the inner periphery of the cavity. The waterproofing annular member may be compressed in an axial direction and in a radial direction between an engaging face formed on the inner periphery of the cavity and an engaging flange formed on the outer periphery of the terminal metal fixture and between the outer periphery of the fixture and the inner periphery of the cavity.

Even if the distal ends of the terminal metal fixtures are exposed at openings of the cavities in the front end of the connector housing and the front end is wetted with water, the waterproofing annular members prevent water from entering the inner part in connector housing through the clearances between the inner peripheries of the cavities and the outer peripheries of the terminal metal fixtures.

Since the present invention can prevent water from entering the inner part of the connector housing through the clearances between the inner peripheries of the cavities and the outer peripheries of the terminal metal fixtures, entrance of water into the inner part in the connector housing can be prevented even if the connector is detached from the mating connector to expose the terminal metal fixtures.

DETAILED DESCRIPTION OF THE PREFERRED EMBODIMENTS

Next, embodiments of a waterproof connector of the present invention will be described below by referring to FIGS. 1 through 6.

First Embodiment

Figure 1:
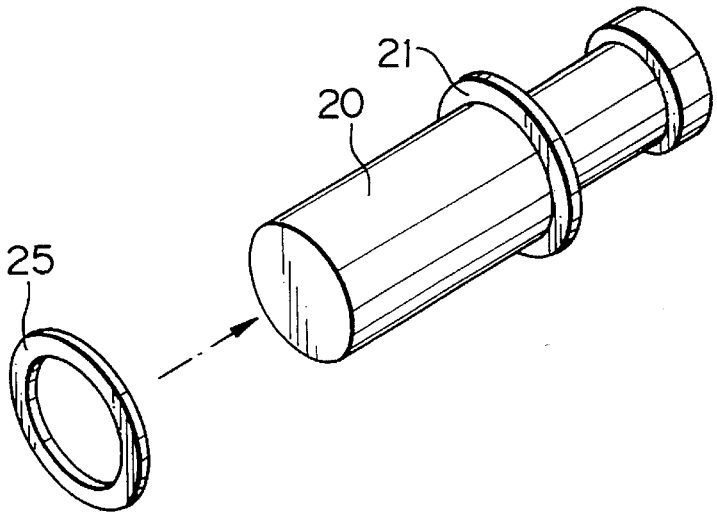
FIG. 1 is an exploded perspective view of parts in a first embodiment of a waterproof connector of the present invention.
Figure 2:
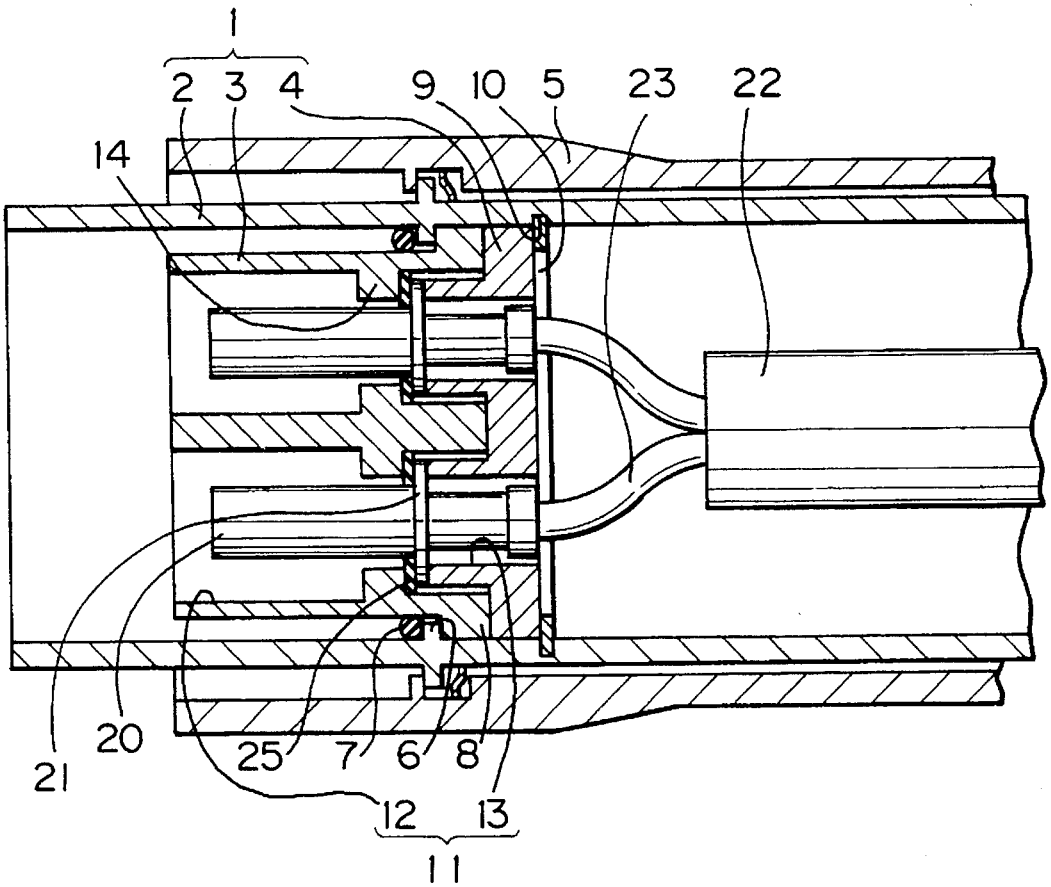
FIG. 2 is a longitudinal sectional view of the first embodiment of the waterproof connector provided with the parts shown in FIG. 1.

FIGS. 1 and 2 show a first embodiment in which a waterproof connector of the present invention is applied to a charging connector for electric vehicles.

A connector housing 1 of the charging connector for electric vehicles comprises a cylindrical housing case 2 on an outer periphery of which a sleeve 5 is fitted, a cylindrical front housing 3, and a cylindrical rear housing 4.

The housing case 2 is provided on its interior with an annular engaging projection 6. An O-ring 7 is disposed between an inner periphery of the housing case 2 and a front side of the projection 6. The O-ring 7 is compressed between a connector housing of a mating connector (not shown) connected to a vehicle battery (not shown) and the projection 6 when a front end of the mating connector housing is inserted into the housing case 2. When the connectors are interconnected to carry out charging, water is prevented from entering an inner part in the connector housing 1 through a clearance between coupled portions of both connector housings.

The front housing 3 and rear housings 4 are inserted into the housing case 2 from the rear side. An annular projection 8 formed on a rear end of the front housing 3 engages with a rear side of the projection 6 on the housing case 2. The rear housing 4 contacts with a rear side of the front housing 3. A retainer ring 10 disposed in a groove 9 formed in the inner periphery of the housing case 2 engages with a rear side of the rear housing 4. Thus, the front and rear housings 3 and 4 are clamped between the projection 6 and a retainer ring 10 so that they cannot move axially in the housing case 2.

Cylindrical front cavities 12 are formed in the front housing 3. Cylindrical rear cavities 13 are formed coaxially with the front cavities 12 in the rear housing 4. A front end of the rear cavity 13 projects in a cylindrical shape and enters a rear end of the front cavity 12. The front and rear cavities 12 and 13 constitute a cavity 11 adapted to accommodate a terminal metal fixture (contact) 20.

The terminal metal fixture 20 is formed into a pin shape having a circular cross section and is provided on its outer periphery with a flange 21. A rear end of the terminal metal fixture 20 is connected to a distal end of an electrical wire 23 of a cable 22 extending from a charger not shown. A thin ring like waterproofing member 25 made of a rubber material is fitted on the terminal metal fixture 20 so that the member 25 contacts with the flange 21. The terminal metal fixture 20 is inserted in the cavity 11 with the flange 21 and member 25 being clamped between a projection 14 formed on an inner periphery of the front cavity 12 and a cylindrical front end mouth of the rear cavity 13.

An example of processes of fitting the terminal metal fixture 20 in the cavity 11 is described below. First, the electrical wire 23 is inserted into the rear cavity 13 or the rear end portion of the terminal metal fixture 20 is inserted into the rear cavity 13 so that the flange 21 of the fixture 20 is disposed forwardly from the rear housing 4 upon coupling the electrical wire 23 to the terminal metal fixture 20. Under this state, the electrical wire 23 is coupled to the terminal metal fixture 20 by means of soldering. Secondly, the front housing 3 is inserted into the housing case 2 so that the annular projection 8 engages with the projection 6. Under this state, the terminal metal fixture 20 is inserted into the front cavity 12 and the flange 21 engages with the projection 14. Then, the rear housing 4 is inserted into the front cavity 12 so that the rear housing 4 engages with the front housing 3, thereby clamping the flange 21 of the fixture 20 between the front and rear housings 3 and 4. Finally, a retainer ring 10 is fitted in the housing case 2 so as to position the front and rear housings 3 and 4 and to maintain the terminal metal fixture 20 at the same time.

Next, an operation of the first embodiment will be explained below.

When the connector of this embodiment is detached from the mating connector, the distal ends of the terminal metal fixtures 20 are exposed outwardly from the front opening in the connector housing 1. Thus, these portions may be exposed to water. However, even if the inner peripheries of the cavities 11 and the outer peripheries of the terminal metal fixtures 20 are wetted with water, the waterproofing members 25 disposed therebetween prevent the water from entering the inner part in the connector housing 1 through clearances therebetween.

Second Embodiment

Figure 3:
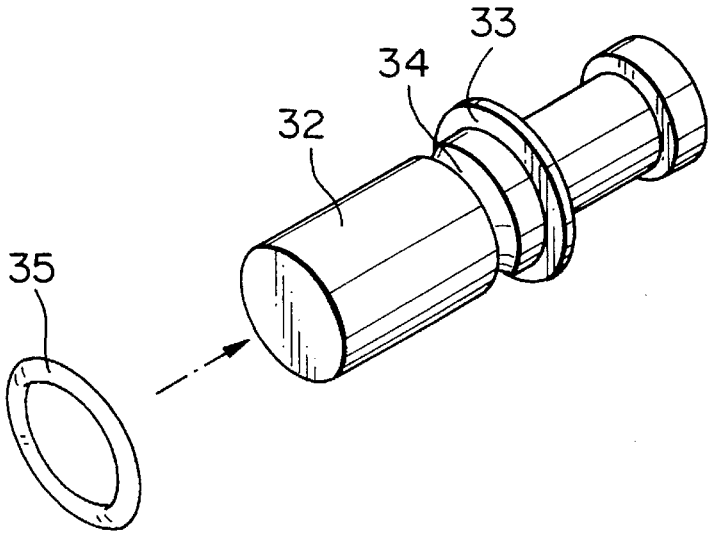
FIG. 3 is an exploded perspective view similar to that shown in FIG. 1, illustrating parts in a second embodiment of the waterproof connector of the present invention.
Figure 4:
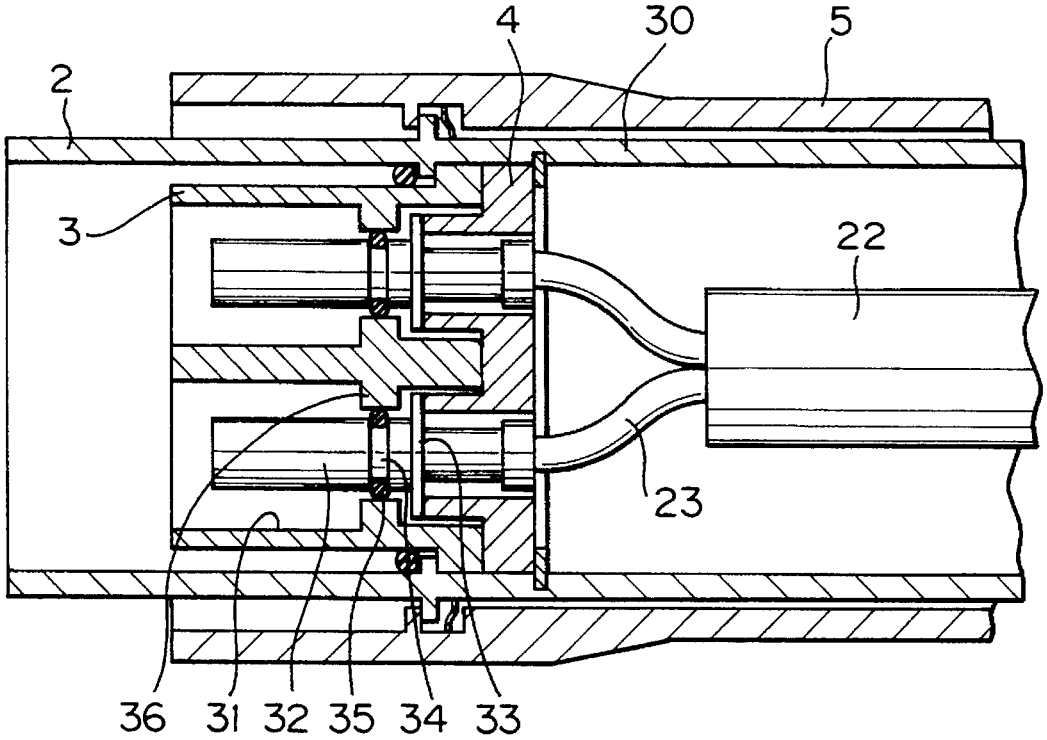
FIG. 4 is a longitudinal sectional view similar to that shown in FIG. 2, illustrating the second embodiment of the waterproof connector provided with the parts shown in FIG. 3.

FIGS. 3 and 4 show a second embodiment in which a waterproof connector of the present invention is applied to a charging connector for electric vehicles.

The connector in the second embodiment differs from that in the first embodiment with respect to means for waterproofing clearances between cavities 31 and terminal metal fixtures 32.

The terminal metal fixture 32 is provided with a groove 34 having an arcuate cross section in its outer periphery on the front side from a flange 33. A water-proofing member 35 made of an O-ring is mounted on the groove 34. The waterproofing member 35 is compressed between a curved face of the groove 34 and a projection on the cavity 31. Thus, clearances between the inner peripheries of the cavities 31 and the outer peripheries of the terminal metal fixtures 32 are sealed against entrance of water. When the connectors are separated from each other to expose openings of the cavities 31 and distal ends of the terminal metal fixtures 32, water is prevented from entering an inner part of a connector housing 30 through clearances between the cavities 31 and the terminal metal fixtures 32.

A construction in the second embodiment except the waterproofing means is the same as that in the first embodiment.

Third Embodiment

Figure 5:
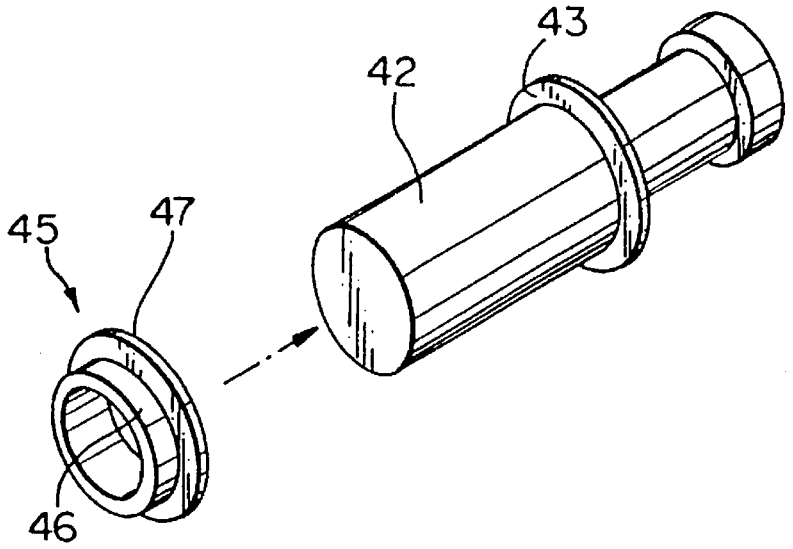
FIG. 5 is an exploded perspective view similar to that shown in FIG. 1, illustrating parts in a third embodiment of the waterproof connector of the present invention.
Figure 6:
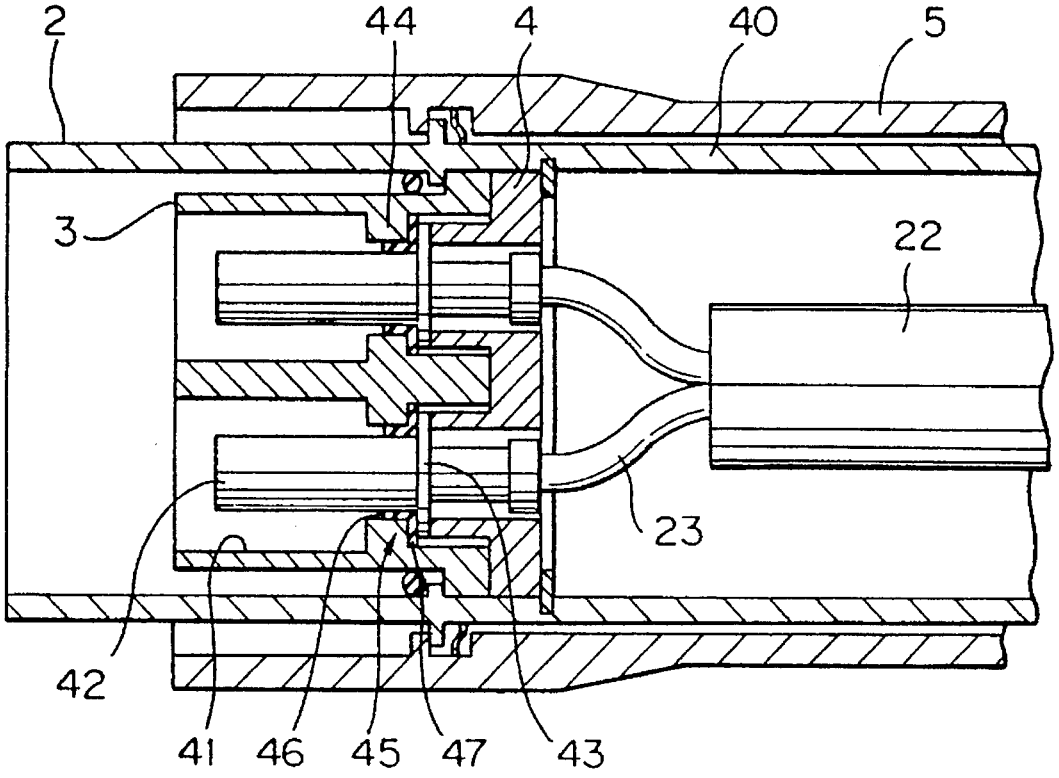
FIG. 6 is a longitudinal sectional view similar to that shown in FIG. 2, illustrating the third embodiment of the waterproof connector provided with the parts shown in FIG. 5.
Figure 7:
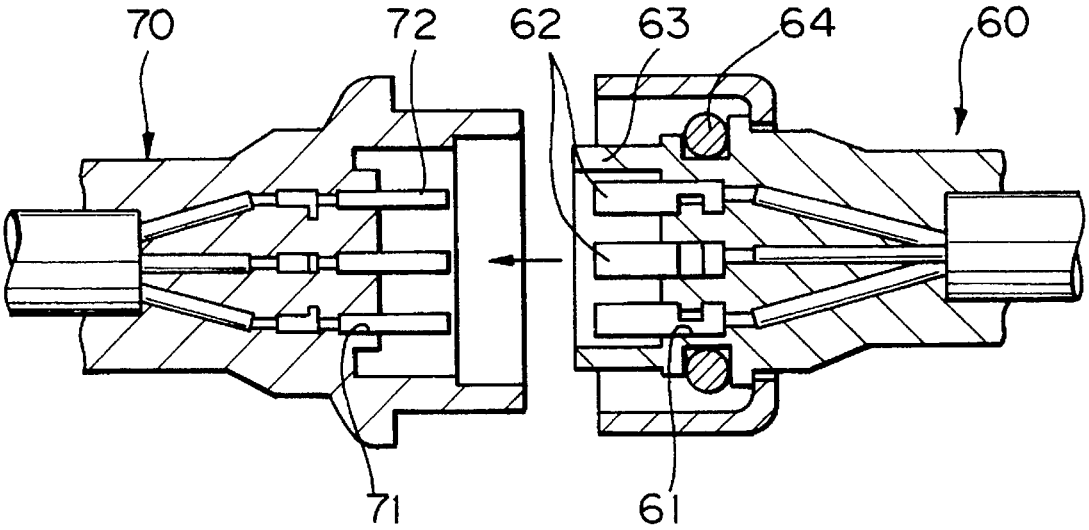
Fig. 7 PRIOR ART
FIG. 7 is an exploded longitudinal sectional view of a conventional waterproof connector.

FIGS. 5 and 6 show a third embodiment of the present invention.

In the third embodiment, means for waterproofing clearances between cavities 41 and terminal metal fixtures 42 utilize a waterproofing member 45 which includes a short sleeve portion 46 and a rear flange portion 47. The portions 46 and 47 are united in an L-shaped cross section. The sleeve portion 46 of the member 45 closely mounts on an outer periphery of the terminal metal fixture 42 while the flange portion 47 of the member 45 closely contacts with a front side of a flange 43 of the fixture 42.

The other construction except the waterproofing means in the third embodiment is the same as that in the first embodiment.

When the terminal metal fixture 42 provided with the waterproofing member 45 is inserted into a cavity 41, the sleeve portion 46 of the member 45 is compressed between the outer periphery of the fixture 42 and an inner periphery of a projection 44 on the cavity 41 while the flange portion 47 of the member 45 is compressed between a rear side of the projection 44 and the flange 43 of the fixture 42. Thus, clearances between the inner periphery of the cavities 41 and the outer peripheries of the terminal metal fixtures 42 are sealed by the waterproofing members 45.

Even if the connector of the third embodiment is detached from the mating connector not shown, so that openings of the cavities 41 and distal ends of the terminal metal fixtures 42 are exposed outwardly, and even if the inner peripheries of the cavities 41 and the outer peripheries of the fixture are wetted with water, the water is impeded from entering the inner part of a connector housing 40 through clearances between the cavities 41 and the fixtures 42.

Further, since the waterproofing member 45 in this embodiment has the L-shaped cross section and is compressed in the axial and radial directions between the cavity 41 and the terminal metal fixture 42, the distal end of the fixture 42 will be swung together with elastic deflection of the sleeve and flange portions 46 and 47 of the waterproofing member 45, when an external force is applied to the fixture 42. Accordingly, when the terminal metal fixture 42 is coupled to a terminal metal fixture in the mating connector not shown, even if axial centers of both fixtures are shifted, both terminals will be smoothly coupled to each other by means of swinging action of the fixtures.

The present invention is not limited to the above embodiments. For example, the present invention may be altered as follows:

(a) Although the above embodiments are applied to a male connector, the present invention can be applied to a female connector;

(b) Although the above embodiments are applied to a charging connector, the present invention can be applied to a battery connector in electric vehicles.

What is claimed is:

1. A waterproof connector wherein terminal metal contacts are inserted in cavities in a connector housing, characterized in that a waterproofing annular member comprised of a short sleeve portion and a rear flange portion to form an L-shaped cross-section is disposed between an inner periphery of each cavity and an outer periphery of each of said terminal metal contacts said flange portion of the waterproofing annular member being compressed in an axial direction and between an engaging face formed on said inner periphery of said cavity and an engaging flange formed on said outer periphery of each of said terminal metal contacts and the sleeve portion compressed radially between the outer periphery of each of said contacts and the inner periphery of said cavity.

* * * * *